United States Patent [19]

Williams

[11] 4,211,244

[45] Jul. 8, 1980

[54] SMOKING DEVICE

[76] Inventor: Shane Williams, Rte. 1, Box 23, Muldrow, Okla. 74948

[21] Appl. No.: 962,347

[22] Filed: Nov. 20, 1978

[51] Int. Cl.[2] ..... A24F 1/04; A24F 47/00

[52] U.S. Cl. ..... 131/194; 131/171 R

[58] Field of Search ..... 131/171, 173, 178, 181, 131/215 R, 215 A, 215 B, 170 R, 170 A, 193–195

[56] References Cited

U.S. PATENT DOCUMENTS

| | | | |
|---|---|---|---|
| 55,321 | 6/1866 | Masson | 131/173 |
| 1,034,717 | 8/1912 | Leeder | 131/181 X |
| 2,960,981 | 11/1960 | Robertson | 131/171 X |
| 3,705,590 | 12/1972 | Rains | 131/170 A |
| 3,805,806 | 4/1974 | Grihalva | 131/173 |
| 3,902,506 | 9/1975 | Hawie | 131/178 X |
| 3,994,307 | 11/1976 | Loeffler | 131/171 R |
| 4,036,240 | 7/1977 | Murray, Jr. | 131/173 |
| 4,071,035 | 1/1978 | Boyd et al. | 131/173 |
| 4,083,374 | 4/1978 | Jacobsen | 131/178 |

FOREIGN PATENT DOCUMENTS 687571 of 1930 France .

*Primary Examiner*—Stephen C. Pellegrino
*Attorney, Agent, or Firm*—Dowell & Dowell

[57] ABSTRACT

A smoking apparatus which may be directly and selectively mounted on conventional smoke generating containers so as to receive, cool and concentrate the smoke discharged therefrom and retain such smoke for periodic inhalation by a person using the apparatus.

5 Claims, 5 Drawing Figures

SMOKING DEVICE

BACKGROUND OF THE INVENTION

1. Field of the Invention

This invention relates generally to smoking implements for tobacco and similar products and specifically to a smoke receiving chamber which may be selectively mounted on conventional smoke generating containers to thereby receive smoke generated from such containers, diffuse the smoke allowing it to cool, and to thereafter channel or direct the smoke to the lower portion of the tapered chamber where it is concentrated as it settles by fluidic action so as to be maintained in such concentrated state until selectively withdrawn or inhaled.

SUMMARY OF THE INVENTION

The present invention is embodied in a smoke receiving apparatus for selective attachment to the discharge port of conventional smoke generators used with cigarettes and similar tobacco and tobacco-like products. The apparatus includes a container or chamber having side walls which form a sloped or tapered housing which has a lid disposed across one end thereof and a mounting portion adjacent the opposite end. The mounting portion is formed so as to be selectively mounted or received about the discharge spout or port of the smoke generator. A check valve and screen are provided along the mounting portion so that smoke discharged from the smoke generator can pass through the mounting portion of the container and thereafter be diffused by the screen as it passes into the tapered main body or chamber of the apparatus. A plurality of small air vents are provided in the lid or top so as to permit relatively clear air to be exhausted from the chamber as the smoke is discharged therein from the smoke generator.

In the preferred embodiment of the invention, an elongated smoke inhaling tube is disposed through the lid portion and into the tapered chamber so that the inlet is positioned at the base of the converging walls of the chamber where the cooled smoke is concentrated.

It is the primary purpose of this invention to provide an apparatus for use in smoking tobacco and similar products which is adapted to be selectively mounted on conventional smoke generators so as to directly receive the smoke discharged from such generators and cause such smoke to be retained, cooled and concentrated for selective use.

It is another object of the invention to provide a smoking appliance which permits the user to periodically withdraw or inhale the smoke of a lighted product which smoke may be inhaled at some time after the lighted product is extinguished or at some period after the smoke has been received within the appliance.

It is a further object of this invention to provide a chamber for receiving and retaining the smoke by-product from the combustion of tobacco and similar products whereby the amount of smoke dissipated into the air is significantly reduced while smoking.

It is another object of this invention to provide a smoking device which will accumulate smoke received from another source and thereafter cause such smoke to become settled or concentrated so that a smoker may withdraw and inhale a concentrated or less air diluted quantity of smoke.

DESCRIPTION OF THE PREFERRED EMBODIMENT

Figure 1:
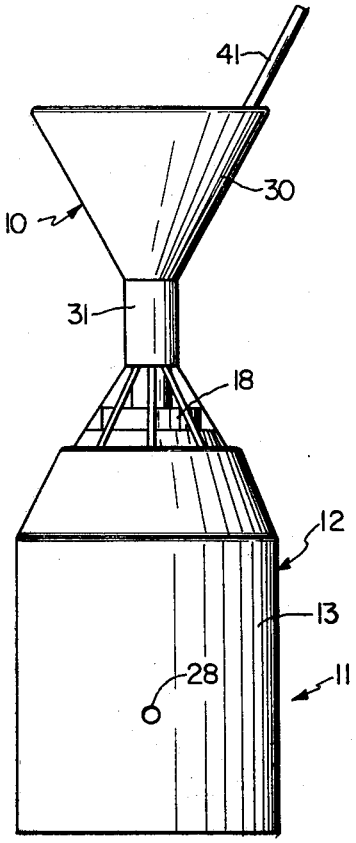
FIG. 1 is a front view illustrating the tapered smoke retaining apparatus as mounted on a conventional smoke generator.
Figure 2:
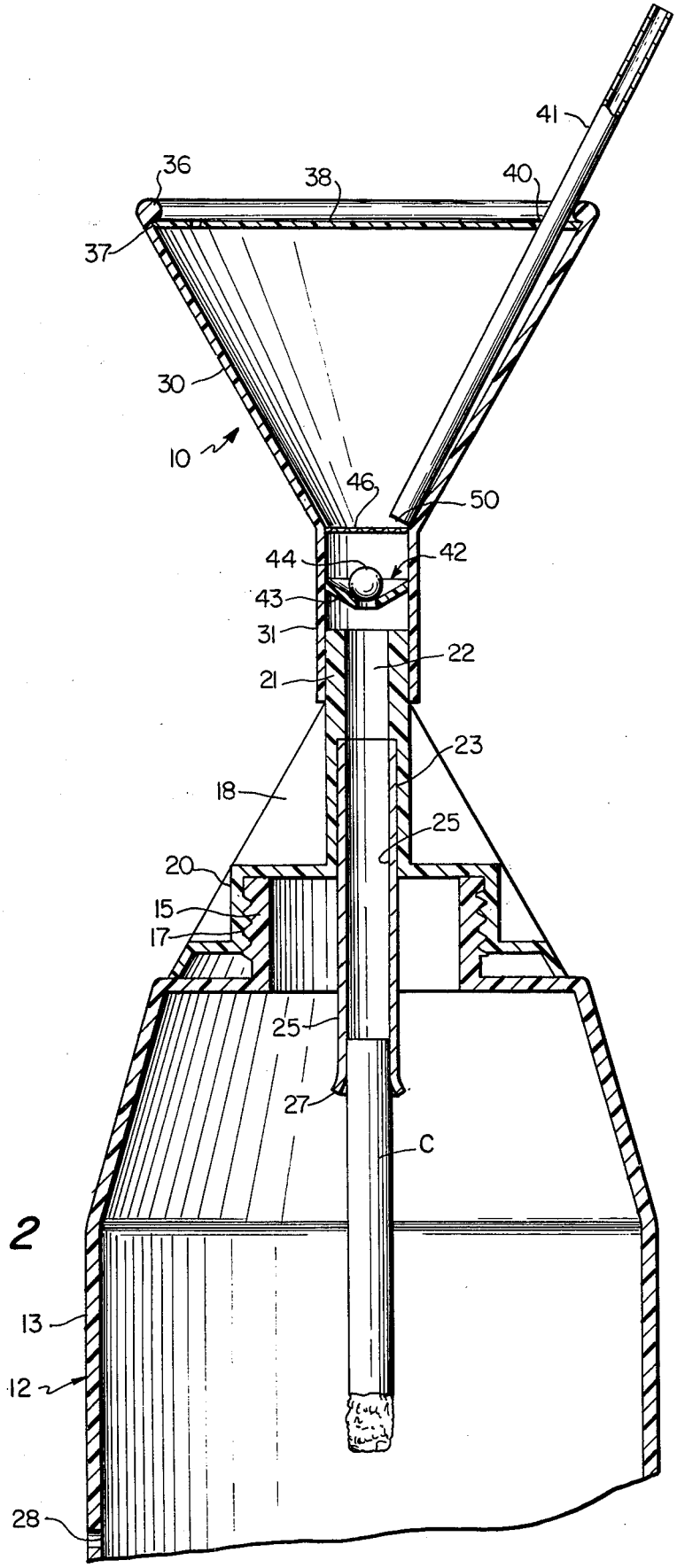
FIG. 2 is an enlarged fragmentary vertical section of the apparatus of FIG. 1.

With continued reference to the drawings, the smoke collector and concentrator 10 of the present invention is shown as mounted on a conventional smoke generating apparatus 11. Briefly, the smoke generating apparatus generally consists of a substantially closed container 12 having a generally flexible and substantially cylindrical body 13, bottom wall 14, and neck 15 defining an opening 16 into the container. The neck 15 may be threaded as at 17 to selectively receive a cigarette or smoking product holder and cap assembly 18.

The smoking product holder assembly 18 is shown as having a mounting portion 20 which threadedly engages the neck of the container at 17. An elongated tubular member 21 extends outwardly from the mounting portion 20 and forms a mouthpiece through which smoke may be inhaled directly from the container. The tubular member 21 is provided with an axial bore 22 having a concentric counterbore 23 extending inwardly from one end. In order to support a cigarette C or similar smoking article within the container, an elongated tubular cigarette holder 25 is secured within the counterbore 23 of the mouthpiece 21 so as to be co-axial therewith so that smoke is discharged through the bore 22. The innermost portion of the cigarette holder may be slightly flared as at 27 to guide one end of a cigarette as it is inserted into the holder 25.

As previously discussed, the container has a flexible body portion 13. This body portion may be constructed of any suitable thermoplastic material which in addition to flexibility also exhibits heat resistance so as to permit the container to be used without being damaged by the heat generated when a lighted cigarette is disposed therein.

After the container has been flexed to discharge a volume of gas contained therein, air may enter the container and allow it to expand to its original shape through relatively small air vents or openings 28 which are provided through the body portion 13, which are opened and closed by thumb or finger action.

Figure 3:
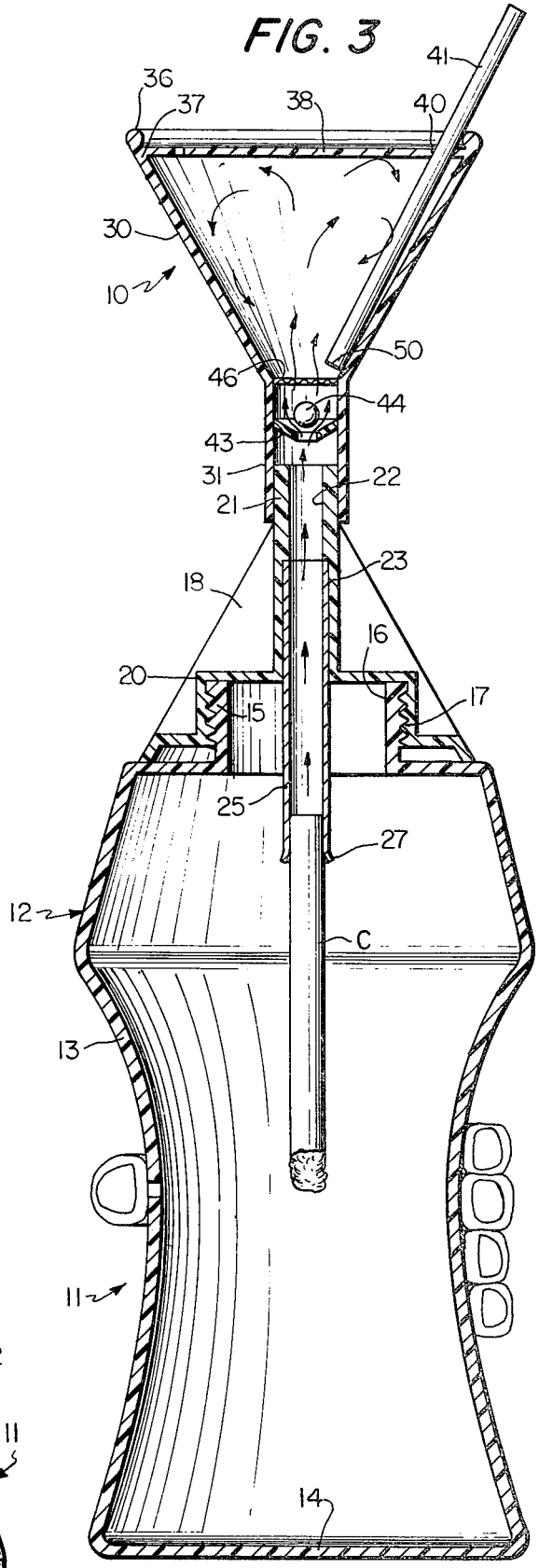
FIG. 3 is a cross-sectional view illustrating the discharge of smoke from a generator into the apparatus of the invention.

In use, the tobacco product mounting holder 18 is removed from engagement with the main body of the container and a cigarette C is inserted in the holder 25. After the tip of the cigarette is ignited, the cap is secured to the container so as to dispose the cigarette within the body of the generator. Sufficient air to support combustion is permitted to enter the container via an opening 28 in the container wall 13. As the cigarette burns, not only are the ashes captured within the container, but the smoke will also be substantially maintained therein. When it becomes desirable to inhale the smoke, the user need only squeeze the container while covering the opening 28, as shown in FIG. 3, to thereby cause the air entrained smoke to be discharged through the cigarette holder and mouthpiece assemblies. Further, once the tobacco product has been fully combusted, the smoke retained within the container is still available for added smoking pleasure.

Although the container or smoke generator does provide for an initial concentration of smoke, such concentration may not be adequate or sufficient for the smoker. Further, the heat of the smoke as it is discharged along the lighted cigarette and through the holder 25 and the bore 22 in many instances may be objectionable. Therefore, in order to permit a further concentration of the smoke and to also allow for a desired cooling of the smoke, the smoke retaining and concentrating assembly 10 has been developed to be used in conjunction with the smoke generator.

As shown in the drawings, the smoke concentrator 10 includes a generally funnel shaped configuration having a conical body or housing 30 integrally connected to a generally tubular mounting portion 31 which is of a size to frictionally or slidably receive the mouthpiece 21 of the container so as to form a passageway which is in axial and open communication with the bore 22 of the smoke generator. The outermost annular edge or rim of the housing 30 is provided with an inwardly extending bead 36 to create an annular groove 37 in which a circular lid 38 is frictionally or otherwise retained.

Figure 5:
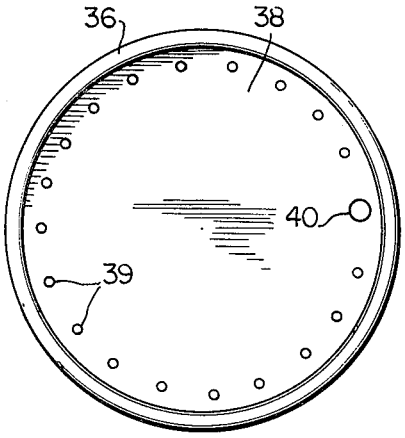
FIG. 5 is a top plan view of the apparatus.
Figure 4:
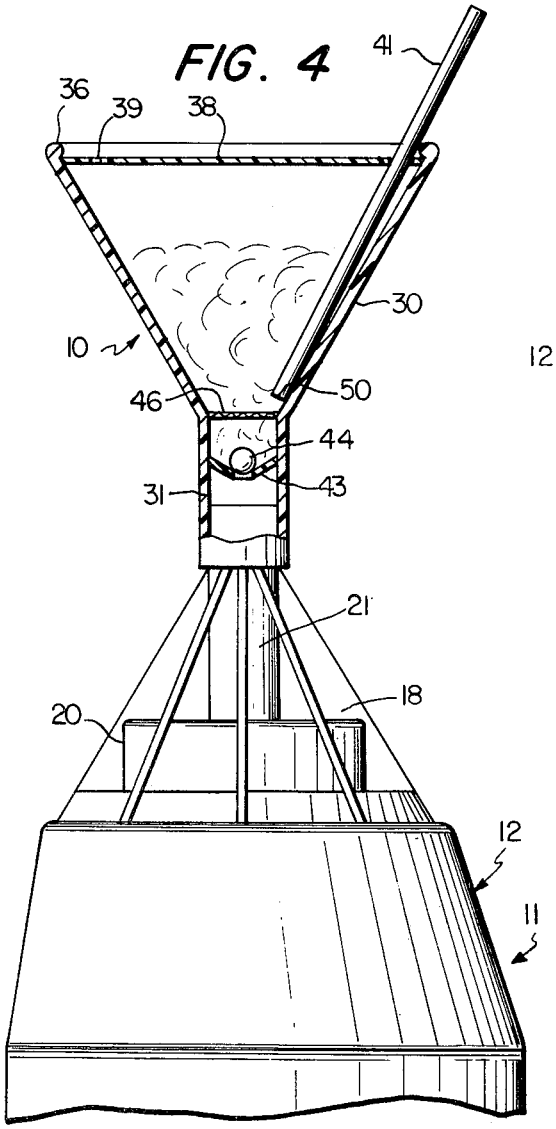
FIG. 4 is a fragmentary side elevation with portions broken away illustrating the invention after smoke has been discharged therein.

With particular reference to FIG. 5, the lid 38 is provided with a plurality of relatively small air vents or openings 39 which function to allow air to escape from within the concentrator 10 when smoke is being received or introduced therein through the mounting portion 31. In addition to the small air vents 39, a larger generally circular opening 40 is provided adjacent the edge of the lid so as to selectively and slidably receive an elongated tubular smoking stem 41.

The concentrator 10 is provided with a check valve 42 which is disposed across the passage defined by the tubular mounting portion 31. The valve may be constructed in any suitable manner but is shown in the drawings as having an annularly shaped valve seat 43 and a gravity responsive ball check valve member 44 which is disposed so as to be seated against the valve seat to prevent air flow from the housing 30 back through the mounting portion 31 to the bore 22.

A fine mesh screen member 46 is also mounted within the concentrator 10 and is preferably disposed so as to extend across the tubular mounting portion 31. Smoke passing through the valve 42 will be diffused as it passes into the housing 30 through the screen 46 and such diffusion will effect the cooling as well as the dispersion of smoke particles to increase the rate of particle settlement.

The construction of the smoke concentrator 10 is such as to permit smoke received from a conventional smoke generator to be concentrated and cooled prior to being inhaled by the smoker. In use, the mounting portion 31 of the concentrator 10 is simply mounted on the mouthpiece 21 of the smoke generator 11. In the drawings, this mounting is shown as a frictional connection, however, it should be understood that the connection could be made in any suitable manner, as for example, by screw threads.

After the concentrator 10 is seated on the smoke generator, the smoking stem 41 is inserted through the larger opening 40 and guided downwardly or inwardly until the inlet end or tip 50 is in close proximity to or engages the screen 46. It is noted that the smoking stem 41 is of sufficient length to extend from the innermost converging point of the concentrator housing 30 to a point which is exterior of the lid 38. In this manner, smoke settling and concentrating within the lower portion of the funnel-shaped housing can be selectively inhaled through the stem 41.

In operation and after a lighted cigarette C is placed within the generator 11, the opening 28 is covered and the flexible body 13 of the generator 11 is compressed so as to force smoke through the holder 25 and bore 22 into the tubular portion 31. As the pressure is increased, the check valve 42 opens so that the smoke is allowed to pass into the concentrator housing 30 after being diffused by the screen 46. Further, the small air vents 39 in the lid 38 allow air to be displaced outwardly of the concentrator as the smoke enters the housing 30.

After a sufficient quantity of smoke is discharged into the concentrator, the pressure on the generator is relaxed and the opening 28 is uncovered. As the flexible body 13 expands, the ball valve 44 closes against the valve seat 43 by gravity as well as by pressure since the pressure in the concentrator becomes greater than that of the generator due to the expansion of the body portion 13. Therefore, the ball check valve restricts or prevents the passage of smoke back into the generator.

The smoke particles which are now captured within the concentrator will settle toward the lower end thereof. The smoker may then selectively inhale the concentrated smoke upwardly through the stem 41.

Although the shape of the concentrator has been discussed as being funnel-like, other shapes which would permit a natural gravitational channeling and concentrating of the smoke particles as they settle are also possible. For instance, the concentrator could be oval or spherical. As the air in which the smoke particles are entrained is cooled and as the particles are heavier than air, the particles will settle toward the downwardly disposed converging end of such shapes and thus will be concentrated.

Also to enable a smoker to readily determine how much smoke is in the concentrator housing 30 and the extent of cooling and smoke concentration, the housing or chamber 30 is preferably constructed of a transparent or translucent plastic or glass material.

Further, in some instances, it may be possible after the smoke has settled sufficiently to actually pour the smoke from the concentrator. Thus in some instances, the smoker can inhale the concentrated smoke directly from the housing 30 without the aid of the stem 41.

I claim:

1. A smoking apparatus for use with a smoke generator having a smoke producing source therein and means for operating the smoke generator, comprising a container, means for connecting said container to the smoke generator, said container having a first opening providing communication between the smoke generator and the interior of said container so that when said smoke generator is operated, the smoke is discharged from the smoke producing source into said container, valve means in said container for substantially preventing the return of the smoke to the generator, at least one second opening in said container to vent the air therefrom while smoke is being introduced, said container defining a pocket in which particles of smoke may settle and be concentrated, and means for selectively removing the concentrated smoke particles from said container.

2. The invention of claim 1 in which said container includes a portion that is substantially frusto-conical in cross section and the smoke from said generator is received within said portion.

3. The invention of claim 1 including screen means mounted within said container adjacent to said first opening to diffuse smoke particles passing into said container.

4. The invention of claim 1 in which said means for preventing the return of smoke includes a partition located within said container and in which said first opening is located, valve means associated with said partition for normally closing said first opening, said valve means being opened when smoke passes from the generator into said container.

5. A smoking apparatus comprising the combination of a smoke generator and a container, said generator including a flexible hollow body having side walls and end walls, one of said end walls having an opening, cap means closing the opening in said one wall, said cap means having means for supporting a smoke producing source, said container including a hollow body, means for mounting said container on said means for supporting a smoke producing source, said container having a first opening providing communication between said generator and the interior of said container, means for operating said generator to cause smoke to be discharged from said smoke producing source into said container, said container having at least one second opening to vent the air therefrom while smoke is being introduced, said container defining a pocket in which the particles of smoke are cooled and concentrated, and means for selectively removing particles of smoke from said container.

* * * * *